US006282372B1

(12) United States Patent
Boros et al.

(10) Patent No.: US 6,282,372 B1
(45) Date of Patent: Aug. 28, 2001

(54) MULTI-POSITION POINT OF USE ELECTRIC WATER HEATER

(75) Inventors: Jozef Boros; Subbu Thenappan, both of Montgomery, AL (US)

(73) Assignee: Rheem Manufacturing Company, New York, NY (US)

( * ) Notice: Subject to any disclaimer, the term of this patent is extended or adjusted under 35 U.S.C. 154(b) by 0 days.

(21) Appl. No.: 09/547,928

(22) Filed: Apr. 11, 2000

(51) Int. Cl.[7] ..... H05B 3/78; F24H 9/12

(52) U.S. Cl. ..... 392/500; 392/449; 392/501

(58) Field of Search ..... 392/441, 449, 392/454, 497, 498, 501, 502, 500

(56) References Cited

U.S. PATENT DOCUMENTS

| | | | |
|---|---|---|---|
| 1,178,777 | 4/1916 | Apfel . | |
| 1,517,301 | 12/1924 | McMichael et al. . | |
| 1,718,866 | 6/1929 | Macy . | |
| 1,916,861 | 7/1933 | Hynes et al. . | |
| 2,041,630 | 5/1936 | Wright | 122/33 |
| 2,457,597 | 12/1948 | Osterheld | 219/39 |
| 2,467,837 | 4/1949 | Linden | 219/40 |
| 2,918,561 | 12/1959 | Perez | 219/41 |
| 3,310,657 | 3/1967 | Santoro, Jr. | 219/523 |
| 3,546,431 | 12/1970 | Gibbs | 219/335 |
| 3,719,799 | 3/1973 | Takayasu | 219/523 |
| 4,072,847 | 2/1978 | Craven | 219/523 |
| 4,414,464 | 11/1983 | Cloutier | 219/312 |
| 4,514,617 | 4/1985 | Amit | 219/314 |
| 4,593,178 | 6/1986 | Banta et al. | 219/315 |
| 4,752,671 * | 6/1988 | Foster et al. | 392/501 |
| 4,955,573 | 9/1990 | Horvath | 248/313 |
| 5,113,480 * | 5/1992 | Murphy et al. | 392/501 |
| 5,168,546 * | 12/1992 | Laperriere et al. | 392/454 |
| 5,190,260 * | 3/1993 | Daubenspeck | 248/313 |
| 5,293,446 | 3/1994 | Owens et al. | 392/449 |
| 5,487,518 | 1/1996 | McCraney et al. | 248/225.11 |
| 5,682,666 | 11/1997 | Lannes | 29/460 |
| 5,703,998 * | 12/1997 | Eckman | 392/340 |
| 5,761,379 | 6/1998 | Lannes | 392/451 |
| 5,971,336 * | 10/1999 | McCraney | 248/313 |
| 6,069,998 * | 5/2000 | Barnes et al. | 392/498 |
| 6,137,955 * | 10/2000 | Krell et al. | 392/454 |

* cited by examiner

*Primary Examiner*—Teresa Walberg
*Assistant Examiner*—Thor Campbell
(74) *Attorney, Agent, or Firm*—Konneker & Smith, P.C.

(57) ABSTRACT

A point-of-use electric water heater is provided with a unique configuration permitting it to be selectively used in (1) a wall or ceiling-mounted horizontal orientation, (2) a floor or wall-supported vertical orientation, or (3) a wall-supported inverted vertical orientation without any substantial modification of the water heater, thereby advantageously avoiding the previous necessity of manufacturing differently configured water heaters for mounting in these various operational orientations. Specially designed mounting brackets are provided to support the water heater in any of its wall or ceiling-mounted orientations. In one embodiment of the water heater a dual element electric resistance type immersion heater is provided with an integral temperature control structure illustratively in the form of a separate sensing tube having operatively mounted therein a pair of thermistors each operatively associated with a different one of the two heating elements.

18 Claims, 3 Drawing Sheets

MULTI-POSITION POINT OF USE ELECTRIC WATER HEATER

BACKGROUND OF THE INVENTION

The present invention generally relates to apparatus for heating liquid and, in a preferred embodiment thereof, more particularly provides a specially designed multi-position point of use electric water heater.

Point-of-use electric water heaters are relatively small capacity water heaters which are typically capable of storing, for on-demand supply, heated water quantities in the representative range of from about two gallons to about thirty gallons. A small water heater of this type is customarily used to serve a single hot water-using plumbing fixture, such as a sink, or only a few plumbing fixtures, and is operatively positioned relatively close to the fixture(s) that it serves—thus the designation "pointof-use" water heater—as opposed to being located remotely from the fixture(s) which it serves.

The compact size of the typical point-of-use electric water permits it to be conveniently tucked away in a concealed space adjacent its associated plumbing fixture(s) such as, for example, in the cabinet area beneath a sink served by the water heater, in a nearby closet, or above the ceiling area near the fixture(s). Alternatively, the point of use water heater may be mounted in an exposed area near the fixture(s) such as on a wall or ceiling.

To accommodate the space available for the point of use electric water heater, it may be necessary to position the water heater in one of a variety of manners including supporting it in (1) a vertical orientation on the floor or on a wall, with the nominal top end of the water heater facing upwardly, (2) an inverted vertical orientation on a wall, with the top end of the water heater facing downwardly, or (3) a horizontal orientation on a wall, ceiling or other horizontal support structure, with the top end of the water heater facing horizontally.

As conventionally manufactured, a point-of-use electric water heater must be built in several separate configurations to accommodate these differing installation orientations without undesirably degrading the water heating efficiency of the unit or presenting installation difficulties of various types. The need to provide these different configurations, of course, undesirably adds to the manufacturing cost of a given water heater product line and correspondingly limits the installation and performance flexibility of a given water heater configuration.

From the foregoing it can be readily seen that a need exists for a point-of-use electric water heater that eliminates, or at least substantially reduces, these problems, limitations and disadvantages typically associated with conventionally configured point-of-use electric water heaters. It is to this need that the present invention is directed.

SUMMARY OF THE INVENTION

In carrying out principles of the present invention, in accordance with a preferred embodiment thereof, a point of use electric water heater is provided with a unique configuration that permits it to be mounted in a selectively variable one of several horizontal and vertical orientations without having to substantially vary the configuration of the water heater to accommodate variation in its mounting orientation, or reducing its water heating efficiency to an unacceptable extent. This desirably permits the point of use water heater to be manufactured in a single configuration useable in each of its potential mounting orientations.

In its preferred embodiment, the water heater comprises an insulated tank structure adapted to hold a quantity of water, the insulated tank structure having opposite first and second end portions spaced apart along a central axis, the insulated tank structure further having front and rear side portions disposed on opposite sides of a reference plane containing the central axis. Water inlet and outlet tubes longitudinally extend parallel to the central axis and into the interior of the rear side portion of the insulated tank structure through its first end portion. Additionally, an elongated electric resistance type immersion heating structure longitudinally extends through the tank interior at least generally parallel to the central axis, the heating structure being operative to heat water disposed within the insulated tank structure.

A first opening is disposed in the front side portion of the insulated tank structure at its first end portion and extends into the interior of the insulated tank structure. A second opening is disposed in the front side portion of the insulated tank structure at its second end portion and extends into the interior of the insulated tank structure. A temperature and/or pressure relief structure is removably secured to one of the first and second opening and is removably securable to the other of the first and second openings. Additionally, a drain valve structure is removably secured to the other of the first and second openings and is removably securable to the aforementioned one of the first and second openings.

Representatively, the water heater has first and second reference lines extending through its first end portion, with the first reference line being rearwardly offset from the reference plane and transverse to the central axis, and the second reference line being forwardly offset from the reference plane and transverse to the central axis. Preferably, the inlet and outlet tubes are spaced apart along the first reference line, and the heating structure and the first opening are spaced apart along the second reference line. An electrical junction box is mounted on the first end and is preferably rearwardly offset from the inlet and outlet tubes.

According to another feature of the invention, the insulated tank structure has secured thereto a mounting structure which facilitates the vertical and horizontal mounting of the water heater on an adjacent support structure. Preferably, the mounting structure includes an axially spaced pair of elongated mounting bracket members which longitudinally extend transversely to the central axis and have longitudinally central portions secured to the rear side of the insulated tank structure at axially spaced locations on the rear side thereof. Projecting outwardly from these longitudinally central bracket portions are opposite end portions with side edges through which generally L-shaped mounting slots extend, the slots being adapted to receive outwardly projecting portions of support members secured to the support structure on which the water heater is to be mounted vertically or horizontally.

In accordance with another aspect of the invention, the electric resistance type immersion heating structure representatively includes a body portion which is securable to the tank at an opening therein, and first and second elongated electrical resistance type heating elements which longitudinally project from the inner side of the body portion axially into the interior of the tank, one of the first and second heating elements being substantially longer than the other heating element. A temperature control structure is operative to control the operation of the first and second heating elements and representatively includes a heating tube longitudinally projecting outwardly from the inner side of the body portion parallel to the first and second heating elements. First and second thermistors are disposed within the tube, in an axially spaced relationship therein, and are respectively associated with the first and second heating elements.

DETAILED DESCRIPTION

Figure 2:
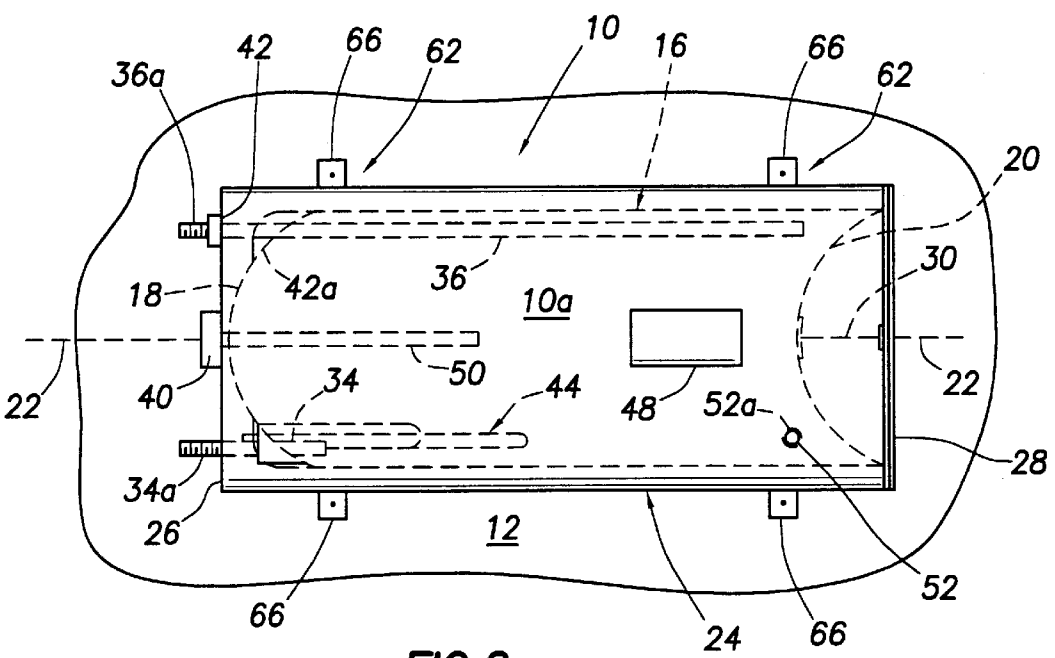
FIG. 2 is a front side elevational view of the horizontally supported water heater.

Illustrated in simplified form in FIGS. 1–4 is a specially designed multi-position point of use electric water heater 10 that embodies principles of the present invention. According to a key aspect of the invention, the water heater 10, as later described herein, may be (1) horizontally mounted on a wall 12 (see FIGS. 1 and 2) or on or above a ceiling (not shown), (2) vertically supported on a floor 14 (see FIG. 3) or the wall 12, or (3) vertically mounted in an inverted orientation on the wall 12. This multi-position orientation of the same water heater 10 may be achieved without substantial modification thereof, and without unduly degrading its water heating performance. This advantageously permits a point of use electric water heater to be manufactured in a single configuration without the previous necessity of building it in several different configurations to enable it to be operatively supported in the various orientations representatively illustrated in FIGS. 1–4.

Still referring to FIGS. 1–4, the illustrated multi-position point of use electric water heater 10 includes a representatively cylindrical metal water storage tank 16 adapted to hold a quantity of heated water deliverable on demand to one or more hot water-using fixtures (not illustrated) with which the water heater 10 is adjacent and operatively associated. Tank 16 has upper and lower ends 18,20 which are spaced apart along a central axis 22 of the water heater 10. A generally conventional metal-jacketed insulation structure 24 outwardly envelopes the tank 16 and has circular upper and lower ends 26 and 28. The lower jacket structure end 28 is tied to the lower end 20 of the tank 16 by a suitable bracket member 30.

Figure 1:
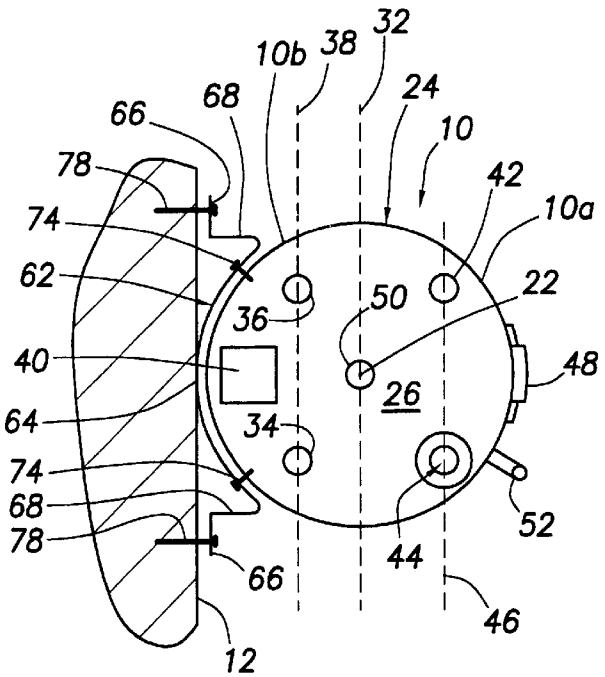
FIG. 1 is a simplified top end view of a specially designed multi-position point of use electric water heater embodying principles of the present invention, with the water heater representatively being horizontally mounted on a wall.
Figure 4:
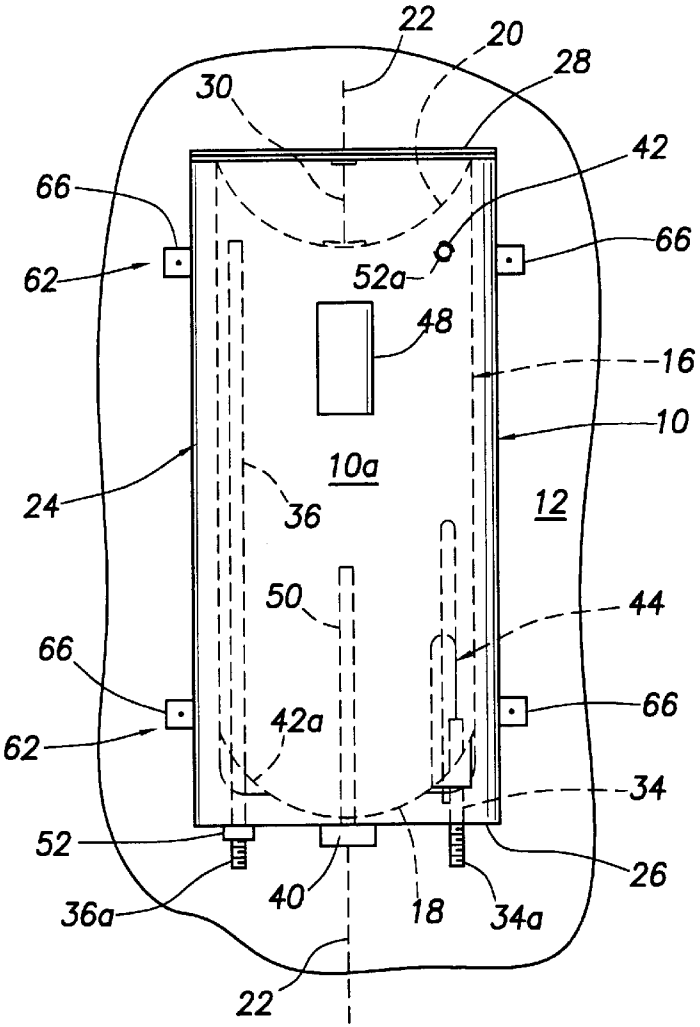
FIG. 4 is a front side elevational view of the water heater in a wall-supported inverted vertical orientation.

For purposes of the description of various positional and configurational aspects of the water heater 10, a reference plane 32 has been shown in FIG. 1. Reference plane 32 extends parallel to and contains the central axis 22, and divides the water heater 10 into circumferentially equal front and rear side portions 10*a* and 10*b*. The front side portion 10*a* of the water heater 10 is shown in FIGS. 2–4, with a portion of the wall 12 (positioned rearwardly of the water heater 10) being shown for reference purposes.

Figure 3:
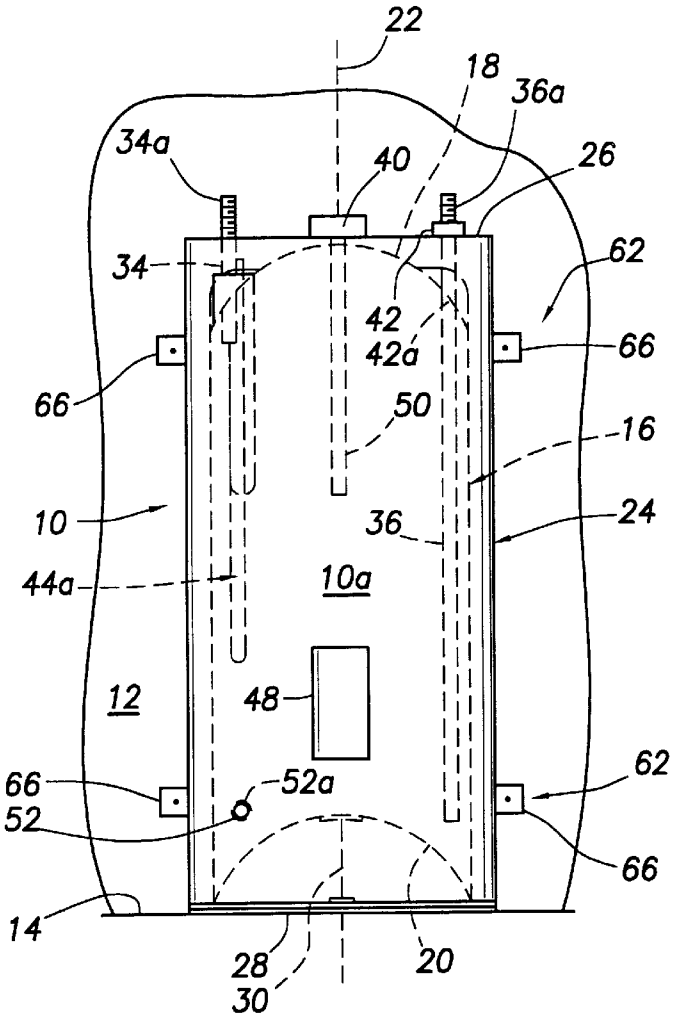
FIG. 3 is a front side elevational view of the water heater in a floor-supported vertical orientation.
Figure 5:
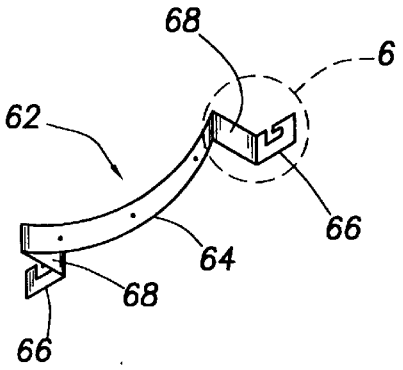
FIG. 5 is an enlarged scale perspective view of a specially designed support bracket used to mount the water heater on a wall or ceiling.
Figure 6:
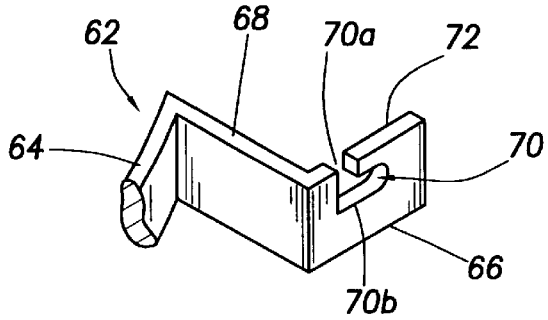
FIG. 6 is an enlarged scale perspective detail view of the end portion of the support bracket generally within the dashed circle area "6" in FIG. 5.

Referring now to FIGS. 1 and 2, water heater 10 includes inlet and outlet tubes 34,36 that longitudinally extend into the interior of the tank 16, parallel to the central water heater axis 22, through the top end 26 of the water heater 10. The tubes 34,36 have exposed outer end portions 34*a*,36*a* respectively connectable to water inlet and outlet pipes (not shown). As best illustrated in FIG. 1, tubes 34,36 are disposed in the rear side portion 10*b* of the water heater 10 and are spaced apart along a dashed reference line 38 (see FIG. 1) which extends chordwise along the top side 26 of the water heater 10, and is rearwardly offset from and parallel to the reference plane 32. An electrical junction box 40 is mounted on the top end 26 of the water heater, generally centered between the inlet and outlet tubes 34 and 36, and rearwardly offset from the reference line 38.

Extending downwardly through the top end 26 of the water heater 10 into the interior of the tank 16 is a conventional temperature and/or pressure relief fitting 42 which is forwardly offset from the reference plane 32, generally aligned with the outlet tube 36, and removably secured to the tank 16 at an opening 42*a* therein. An elongated electric resistance type immersion heater structure 44 longitudinally extends downwardly through the top end of the tank 16 into its interior, is aligned with the inlet tube 34, and is spaced apart from the temperature and pressure relief fitting 42 along a dashed reference line 46 (see FIG. 1) that is forwardly offset from and parallel to the reference plane 32. The immersion heater structure 44 is removably secured to the tank 16 and is operatively controlled by a thermostat 48 which senses the temperature of the water within the tank 16 and is positioned on a lower front side portion of the water heater 10 as schematically indicated in FIG. 2. Alternatively, heater structure 44 could enter the tank 16 through a side thereof, have a suitably bent configuration, and still longitudinally extend generally parallel to the central axis 22.

Cathodic protection is provided for the water heater 10 by means of a conventional elongated anode structure 50 that longitudinally extends centrally through a central top end portion of the tank 16 into its interior. At a lower front end portion of the water heater 10 is a drain valve structure 52 which is removably secured to the tank 16, at an opening 52*a* therein, and is communicated with the interior of the tank 16.

Figure 7:
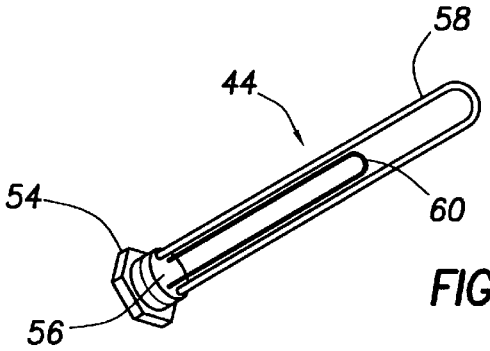
FIG. 7 is an enlarged scale perspective view of a dual element electrical resistance type immersion heating structure used in the water heater.

As illustrated in FIG. 7, the elongated electric resistance type immersion heater structure 44 which longitudinally extends into the interior of the tank in a direction parallel to the central axis 22 is representatively a dual element unit having a hexagonal head portion 54 from one side of which a threaded cylindrical body 56 outwardly projects, the body 56 being removably threaded into a corresponding opening in the upper tank end. Longitudinally extending outwardly from the outer end of the cylindrical body 56 are elongated first and second generally U-shaped first and second resistance type immersion heating elements 58 and 60, the second element 60 being substantially shorter than the first heating element 58. Heater structure 44 is removable from the water heater 10 through its upper end 26. Alternatively, the heater structure 44 could be a single element unit if desired.

With reference now to FIGS. 1, 2, 5 and 6, the multi-position point of use electric water heater 10 also includes a pair of specially designed mounting brackets 62 which facilitate the mounting of the water heater 10 in several subsequently described orientations. Each mounting bracket 62 is an elongated strip of metal having a curved longitudinally central section 64 and straight opposite outer end portions 66 connected to the ends of the curved section 64 by transverse joining portions 66. Formed in each of the end portions 66 is a generally L-shaped slot 70 (see FIG. 6) having an entry portion 70*a* extending inwardly through a side edge 72 of the end portion 66, and a transverse portion 70*b* extending parallel to the edge 72. The curved central portions 64 of the brackets 62 are removably secured to circumferentially aligned top and bottom arcuate portions of the rear side 10*b* of the water heater by threaded fasteners 74 (see FIG. 1).

The multi-position point of use water heater 10 as shown in FIGS. 1 and 2 is horizontally mounted on the wall 12 by first securing on the wall suitably spaced apart support members 76 which project outwardly therefrom. Water heater 10 is then mounted on the wall 12, with the rear side portion 10*b* facing the wall 10 and the drain valve 52 oriented on the bottom side of the horizontal water heater 10, by simply moving the bracket end slot portions 70*a* (see FIG. 6) horizontally parallel to the wall 12 and over the outwardly projecting portions of the support members 78 (which illustratively have laterally enlarged outer end head portions), and then moving the water heater 10 downwardly to cause the outwardly projecting portions of the support members 78 to move into the bracket end slot portions 70*b*. External piping and electrical connections are then made to the horizontally mounted water heater 10.

With the water heater 10 horizontally mounted on the wall 12 in this manner, the water inlet and outlet tubes 34,36 and the electrical junction box 40 are conveniently positioned adjacent the wall 12, to facilitate external piping and electrical connections to the mounted water heater. Additionally, the electrical immersion heater structure 44 is positioned at an underside portion of the horizontally oriented water heater 10 for efficient heating of water stored in the tank 16, and the drain valve structure 52 is positioned on an underside portion of the horizontally oriented water heater 10 for efficient draining of the tank 16 should the need arise. Further, the thermostat 48 is conveniently exposed on the front side of the mounted water heater for ready access and adjustment.

As previously mentioned herein, due to its unique configuration, the same point of use water heater 10 may also be positioned in several other orientations without appreciably modifying the water heater. This advantageously avoids the previous necessity of manufacturing the water heater in a variety of separate configurations in order to accommodate several desired mounting orientations.

For example, the water heater 10 in its FIG. 1 horizontal wall-mounted orientation may alternatively mounted in a horizontal orientation on a ceiling (not shown) or on structure above the ceiling by simply rotating the water 10 ninety degrees in a clockwise direction from its FIG. 1 orientation, operatively connecting the opposite ends 66 of the brackets 62 to horizontally oriented support members secured to the ceiling or structure above the ceiling, and switching the positions of the inlet tube 34 and the temperature and/or pressure relief structure 42.

Additionally, as shown in FIG. 3, the water heater may simply be placed, bottom end 28 down, on the floor 28 with the rear side 10*b* of the water heater 10 facing the wall 12. Further support for the vertically floor-mounted water heater 10 may be achieved by simply connecting the outer ends 66 of the brackets 62 to the wall 12. in this vertically floor-mounted orientation of the water heater 10, the inlet and outlet tube ends 34*a*,36*a* and the junction box 40 are conveniently disposed adjacent the wall 12, and the drain valve structure 52 is positioned at a bottom end portion of the water heater 10 to facilitate drainage of its tank portion 16 if necessary. It will readily appreciated that, if desired, the vertically oriented water heater 10 shown in FIG. 3 may alternatively be wall mounted, with the bottom water heater end 28 spaced upwardly apart from the floor 14, simply by using the brackets 62 to mount the water heater 10 in a vertical orientation on the wall 12.

It is important to note at this point that to switch the water heater 10 from its horizontal orientation shown in FIGS. 1 and 2 to its vertical orientation shown in FIG. 3 it is not necessary to modify the water heater 10 in any manner. However, depending on the tank height of the water heater 10 it may be desirable to substitute a somewhat longer immersion heater structure 44*a* for the previously described immersion heater structure 44 to introduce water heating at a lower location in the tank 16.

Using the same brackets 62 with their L-shaped end portion mounting slots 70 (see FIG. 6) the water heater 10 may be inverted and vertically supported on the wall 12, bottom end 28 up and with the rear side portion of the water heater 10 facing the wall 12, as indicated in FIG. 4. In this orientation of the water heater 10, the brackets 62 are secured to the support members projecting outwardly from the wall by downwardly moving the bracket end slot portions 70*a* over the support members, and then moving the water heater 10 leftwardly as viewed in FIG. 4 to cause the wall support members to enter the horizontal bracket end slot portions 70*a*. As can be seen by comparing the wall installations of the water heater in FIGS. 2 and 4, the L-shaped bracket end slots 70 conveniently adapt the water heater 10 to either vertical or horizontal mounting on the wall 12 without altering the support structure for the water heater.

From the standpoint of reconfiguring the water heater 10 when it is changed from its FIG. 2 horizontal orientation or its FIG. 3 vertical orientation to its FIG. 4 inverted vertical orientation, all that is necessary is to switch the locations of the temperature and pressure relief structure 42 and the drain valve structure 52 and reconnect these structures to the tank 16. in other words, the pressure relief structure 42 is repositioned to and removably connected at the tank opening 52*a*, and the drain valve structure 52 is repositioned to and removably connected at the tank opening 42*a*. As can be seen in FIG. 4, this places the temperature and pressure relief structure 42 in an upper left location of the front side portion 10*a* of the water heater 10, and places the drain valve structure 52 on the inverted top end 26 end of the water heater 10.

Figure 8:
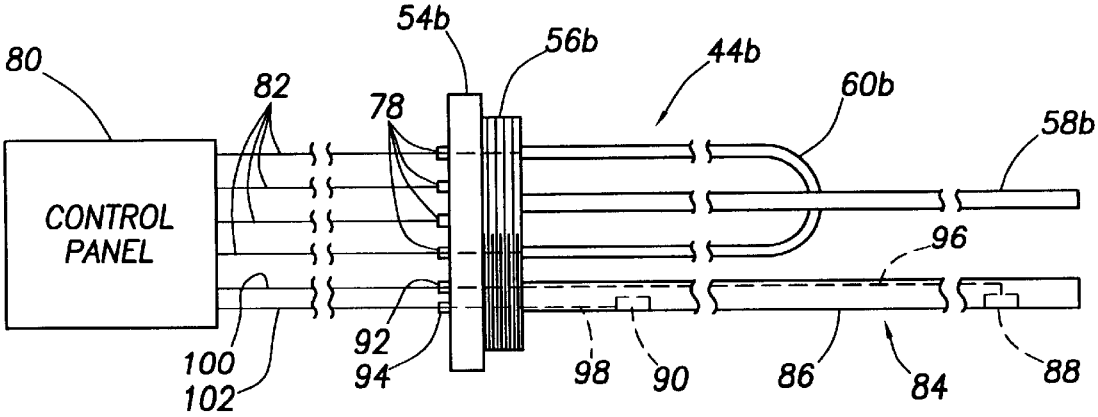
FIG. 8 is an enlarged scale, simplified and longitudinally foreshortened side elevational view of an alternate embodiment of he immersion heating structure shown in FIG. 7.

Illustrated in FIG. 8 is an alternate embodiment 44*b* of the previously described electric resistance type immersion heater structure 44. For ease in comparison between the heater structures 44 and 44*b*, elements in the heater structure 44*b* similar to those in the heater structure 44 have been given identical reference numerals having the subscripts "b".

Heater structure 44*b* includes a hexagonal head portion 54*b* from one side of which an externally threaded cylindrical body portion 56 outwardly projects. Extending outwardly from the right side of the body portion 56*b* as viewed in FIG. 8 are an elongated, generally U-shaped first electric resistance type immersion heating element 58*b*, and a somewhat shorter elongated, generally U-shaped second electric resistance type immersion heating element 60*b*. Heating elements 58*b*,60*b* are electrically coupled to terminals 78 on the left side of the hexagonal head portion 54*b*. In turn, the terminals 78 are coupled to a suitable control panel 80 via electrical leads 82.

Incorporated in the heater structure 44*b* is an integral temperature sensing structure 84 which replaces the thermostat 48 in the water heater 10. The temperature sensing structure 84 includes a closed heat sensing tube 86 longitudinally extending outwardly from the right side of the cylindrical body portion 56*b*. Two temperature sensing thermistors 88 and 90 are carried within the tube 86 in a longitudinally spaced relationship therein, the thermistor 88 being associated with the heating element 58*b*, and the thermistor 90 being associated with the heating element 60*b*. Thermistors 88,90 are respectively connected to terminals 92,94 on the left side of the hexagonal head portion 54*b* by electrical leads 96,98 extending through the interior of the tube 86. Terminals 92 and 94, in turn, are connected to the control panel 80 by electrical leads 100 and 102. During operation of the water heater 10, the control panel 80 uses the water temperature sensed by the thermistor 88 to control the operation of the immersion heating element 58*a*, and uses the water temperature sensed by the thermistor 90 to control the operation of the immersion heating element 60*b*.

The foregoing detailed description is to be clearly understood as being given by way of illustration and example, the spirit and scope of the present invention being limited solely by the appended claims.

What is claimed is:

1. A multi-position point of use electric water heater comprising:

an insulated tank structure adapted to hold a quantity of water, said insulated tank structure having opposite first and second end portions spaced apart along a central axis, said insulated tank structure further having front and rear side portions disposed on opposite sides of a reference plane containing said central axis;

an inlet tube longitudinally extending parallel to said central axis and into the interior of said rear side portion through said first end portion;

an outlet tube longitudinally extending parallel to said central axis and into the interior of said rear side portion through said first end portion;

an elongated electric resistance type immersion heating structure longitudinally extending through the interior of said front side portion at least generally parallel to said central axis, said heating structure being operative to heat water disposed within said insulated tank structure;

a first opening disposed in said front side portion of said insulated tank structure at said first end portion and extending into the interior of said insulated tank structure;

a second opening disposed in said front side portion of said insulated tank structure at said second end portion and extending into the interior of said insulated tank structure;

a temperature and/or pressure relief structure removably secured to one of said first and second openings and being removably securable to the other of said first and second openings; and a drain valve structure removably secured to said other of said first and second openings and being removably securable to said one of said first and second openings, said electric water heater being operative to be mounted in a selectively variable one of a plurality of horizontal and vertical orientations without having to substantially vary its constructional configuration to accommodate variation in its mounting orientation and corresponding reorientation of said heating structure.

2. The multi-position point of use electric water heater of claim 1 wherein:

said water heater has a reference line extending through said first end portion, the reference line being parallel to said reference plane, rearwardly offset from said reference plane, and transverse to said central axis, and said inlet and outlet tubes are spaced apart along said reference line.

3. The multi-position point of use electric water heater of claim 2 further comprising an electrical junction box mounted on said first end portion.

4. The multi-position point of use electric water heater of claim 3 wherein said electrical junction box is rearwardly offset from said inlet and outlet tubes.

5. The multi-position point of use electric water heater of claim 4 wherein said electrical junction box is generally centered between said inlet and outlet tubes.

6. The multi-position point of use electric water heater of claim 1 wherein:

said water heater has a reference line extending through said first end portion, the reference line being parallel to said reference plane, forwardly offset from said reference plane, and transverse to said central axis, and said heating structure and said first opening are spaced apart along said reference line.

7. The multi-position point of use electric water heater of claim 1 wherein:

said heater structure extends through said first end portion of said insulated tank structure.

8. The multi-position point of use electric water heater of claim 1 further comprising a temperature control structure for sensing the temperature of water within said insulated tank structure and responsively controlling the operation of said heating structure.

9. The multi-position point of use electric water heater of claim 8 wherein said temperature control structure includes a thermostat operatively coupled to said heater structure.

10. The multi-position point of use electric water heater of claim 9 wherein:

said heating structure has a body portion from which an elongated heating element portion longitudinally outwardly extends.

11. The multi-position point of use electric water heater of claim 10 wherein:

said temperature control structure includes a temperature sensing portion secured to and projecting outwardly from said body portion.

12. The multi-position point of use electric water heater of claim 11 wherein:

said temperature control structure includes a tube longitudinally extending outwardly from said body portion and having at least one thermistor operatively disposed therein.

13. The multi-position point of use electric water heater of claim 12 wherein:

said heating element portion includes a first elongated heating element longitudinally projecting outwardly from said body portion, and a second elongated heating element longitudinally projecting outwardly from said body portion parallel to said first heating element, and said tube has longitudinally spaced apart first and second thermistors operatively disposed therein and respectively associated with said first and second heating elements.

14. The multi-position point of use electric water heater of claim 1 further comprising a bracket structure connected to said insulated tank structure and useable to mount said water heater in selectively variable vertical and horizontal orientations on a support structure.

15. The multi-position point of use electric water heater of claim 14 wherein said bracket structure includes an elongated bracket member having a longitudinally central portion secured to said insulated tank structure, and opposite end portions with edges through which generally L-shaped slots inwardly extend.

16. The multi-position point of use electric water heater of claim 15 wherein:

said slots have first leg portions extending inwardly through said edges in directions transverse to the length of said bracket member, and second leg portions transverse to said first leg portions and extending generally parallel to the length of said bracket member.

17. A multi-position point of use electric water heater comprising:

an insulated tank structure adapted to hold a quantity of water, said insulated tank structure having opposite first and second end portions spaced apart along a central axis, said insulated tank structure further having front and rear side portions disposed on opposite sides of a reference plane containing said central axis;

an inlet tube longitudinally extending parallel to said central axis and into the interior of said rear side portion through said first end portion;

an outlet tube longitudinally extending parallel to said central axis and into the interior of said rear side portion through said first end portion;

an elongated electric resistance type immersion heating structure longitudinally extending through the interior of said front side portion at least generally parallel to said central axis, said heating structure being operative to heat water disposed within said insulated tank structure;

a first opening disposed in said front side portion of said insulated tank structure at said first end portion and extending into the interior of said insulated tank structure;

a second opening disposed in said front side portion of said insulated tank structure at said second end portion and extending into the interior of said insulated tank structure;

a temperature and/or pressure relief structure removably secured to one of said first and second openings and being removably securable to the other of said first and second openings; and a drain valve structure removably secured to said other of said first and second openings and being removably securable to said one of said first and second openings, said water heater having a first reference line extending through said first end portion, said first reference line being parallel to said reference plane, rearwardly offset from said reference plane, and transverse to said central axis, said inlet and outlet tubes being spaced apart along said first reference line, said water heater having a second reference line extending through said first end portion, said second reference line being parallel to said reference plane, forwardly offset from said reference plane, and transverse to said central axis, said heating structure and said first opening being spaced apart along said second reference line, and said electric water heater being operative to be mounted in a selectively variable one of a plurality of horizontal and vertical orientations without having to substantially vary its constructional configuration to accommodate variation in its mounting orientation and corresponding reorientation of said heating structure.

18. The multi-position point of use electric water heater of claim 17 further comprising:

an electrical junction box mounted on said first end portion and being rearwardly offset from said inlet and outlet tubes.

* * * * *